US010071848B2

(12) United States Patent
Ghia et al.

(10) Patent No.: US 10,071,848 B2
(45) Date of Patent: Sep. 11, 2018

(54) SMART BIN LOTTERY TICKET DISPENSER WITH ELECTRONIC DISPLAYS

(71) Applicant: Scientific Games International, Inc., Newark, DE (US)

(72) Inventors: Ajay J. Ghia, Cumming, GA (US); Kent Christensen, Cumming, GA (US); Sten Hallundbaek Mejenborg, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 5 days.

(21) Appl. No.: 15/394,012

(22) Filed: Dec. 29, 2016

(65) Prior Publication Data

US 2018/0186557 A1 Jul. 5, 2018

(51) Int. Cl.
*B65D 83/12* (2006.01)
*G07D 11/00* (2006.01)

(52) U.S. Cl.
CPC ..... *B65D 83/12* (2013.01); *G07D 11/0072* (2013.01); *G07D 11/0078* (2013.01); *B65D 2203/12* (2013.01)

(58) Field of Classification Search
None
See application file for complete search history.

(56) References Cited

U.S. PATENT DOCUMENTS 4,982,337 A 1/1991 Burr et al.
5,216,595 A 6/1993 Protheroe
5,222,624 A 6/1993 Burr
5,408,417 A 4/1995 Wilder
6,095,624 A 8/2000 Wilbert
6,714,838 B2 3/2004 Scrymgeour et al.
6,886,728 B2 5/2005 Roberts et al.
6,899,621 B2 5/2005 Behm et al.
7,080,755 B2 * 7/2006 Handfield ..... A61J 7/0084 221/13
7,381,132 B2 6/2008 Roberts
7,383,099 B2 6/2008 Pollard et al.
7,665,394 B2 2/2010 Roberts et al.
7,850,257 B2 12/2010 Roberts et al.
8,192,268 B1 6/2012 Karpe
8,463,668 B2 6/2013 Youssef et al.
9,339,121 B2 5/2016 Siciliano et al.
9,582,952 B1 * 2/2017 Brillante ..... G07C 11/00
9,760,939 B2 9/2017 Gleeson et al.
2003/0204288 A1 10/2003 Scrymgeour et al.
2004/0242309 A1 12/2004 Melesko et al.
(Continued)

*Primary Examiner* — Timothy R Waggoner
(74) *Attorney, Agent, or Firm* — Dority & Manning, P.A.

(57) ABSTRACT

A lottery ticket dispenser array includes a plurality of separate bins, with each bin defined by a housing having a defined first internal space for receipt of a supply of interconnected lottery tickets. Each bin has an electronic ticket drive mechanism and a scanner disposed to read a sequential number code as the lottery tickets are dispensed from the bin. A control system is in communication with each scanner. Each bin includes a first electronic display at a front side thereof. The control system is configured for receipt of a scan signal from the scanner and, at the end of a ticket dispense cycle, to determine the lottery ticket number of a next lottery ticket to be dispensed from the bin and to transmit the next lottery number to the first electronic display.

11 Claims, 4 Drawing Sheets

(56) References Cited

U.S. PATENT DOCUMENTS

| | | | | |
|---|---|---|---|---|
| 2005/0233797 | A1* | 10/2005 | Gilmore | G06Q 20/202 463/17 |
| 2006/0071046 | A1 | 4/2006 | Roberts et al. | |
| 2009/0101714 | A1 | 4/2009 | Weyler, III et al. | |
| 2014/0046481 | A1* | 2/2014 | Siciliano | B65D 83/12 700/236 |
| 2017/0018048 | A1 | 1/2017 | Christensen et al. | |
| 2017/0018148 | A1* | 1/2017 | Behm | G07F 17/42 |

* cited by examiner

SMART BIN LOTTERY TICKET DISPENSER WITH ELECTRONIC DISPLAYS

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

For example, U.S. Pat. No. 9,339,121 proposes an electronic lottery ticket dispensing system that includes a plurality of lockable ticket compartments that each dispenses a ticket upon receipt of a dispense trigger signal from a computing device. Inside each ticket compartment resides a dispensing mechanism and an associated motor that actuates the dispensing mechanism. The dispensing mechanism advances at least one ticket from a continuous perforated fan fold of scratch-off lottery tickets. A logic circuit is in communication with the motor, controls motor actuation, and records the number of tickets dispensed. The logic circuit advanced to the exterior of the ticket dispenser. There is also an interface between the logic circuit and a computing device that records the number of tickets sold from the respective compartments. The exterior of the ticket dispenser includes a numeric display that indicates the number of tickets remaining in the ticket compartment. This display is adjacent the dispensing slot and, thus, not visible to the purchaser.

It has been found that many instant lottery players are, to some extent, superstitious and purchase lottery tickets according to certain superstitious beliefs. For example, some players will only purchase tickets on a certain day of the week, or date in a month. Certain players may wear a "lucky" clothing item when purchasing tickets, and so forth. Still further, many players have a lucky number, and are inclined to integrate this number into games of chance. For example, players will play certain lucky numbers in conventional Pick-3 or Pick-5 drawn games.

Unfortunately, to date, players have been unable to integrate their lucky numbers into selection and play of scratch-off lottery tickets. The present invention provides a solution to this problem.

SUMMARY

Objects and advantages of the invention will be set forth in part in the following description, or may be obvious from the description, or may be learned through practice of the invention.

In accordance with aspects of the invention, a lottery ticket dispensing array is provided for dispensing instant or other preprinted lottery tickets at a retail establishment. The type of retail establishment may vary widely within the scope and spirit of the invention. For example, in certain embodiments, the retail establishments may be convenience stores, gas stations, pubs, and any other establishment that typically sells lottery tickets to the public. The present array has particular usefulness for much larger retail establishments, such as "big-box" retail stores that are part of a national or other geographic chain, wherein the sale of lottery ticket sales has generally not been implemented.

The lottery ticket dispenser array includes a plurality of separate bins, for example an array of 3×4 separate bins, wherein each bin is defined by a housing having a front side that faces a purchaser in operational use of the dispenser array, an opposite back side that faces the retail vendor or clerk. Each bin has a defined first internal space for receipt of a supply of interconnected lottery tickets therein, such as a fan-folded stack or roll of interconnected lottery tickets. Each bin may contain a supply of different scratch-off lottery ticket games, or two or more bins may contain a respective supply of tickets for the same game. The lottery tickets are sequentially numbered and each lottery ticket contains a machine readable code printed thereon that includes the lottery ticket number, such as an alpha-numeric code, bar code, QR code, or the like.

Each bin in the array includes an electronic drive mechanism that, when activated, dispenses one or more lottery tickets from the bin (depending on the number of tickets requested by the patron). Each bin also includes a scanner disposed to read the code on lottery tickets dispensed from the bin position. In operation of the system, a purchase signal for dispensing a particular lottery ticket is routed to the respective bin containing the lottery ticket, which activates the drive mechanism to dispense the requisite number of tickets. As the tickets are dispensed from the bin, the scanner reads the code printed on each ticket.

Each bin in the array includes a first electronic display at the front side thereof, such as an LCD display that is located on the front side of the bin so as to be clearly visible to a prospective purchaser. For each bin, a control system is in communication with the scanner and is specifically configured for receipt of the a scan signal from the scanner. For each bin, at the end of a ticket dispense cycle, the control system is specifically configured to determine the lottery ticket number of a next lottery ticket to be dispensed from the bin and to transmit this next lottery number to the first electronic display, which displays this number to the potential purchaser.

Thus, with the unique system configuration of the present invention, the purchaser is presented with the sequential number of the ticket that is available for purchase in each bin, and this number may contain the purchaser's lucky number, which may entice the purchaser to buy such ticket over another ticket in the array.

The control system may determine the number of the next lottery ticket in various ways. For example, once determined, the control system records the sequential number of the next available ticket in the bin and, at the next dispense cycle does a ticket count of the number of tickets dispensed during such cycle and adds such number to the last recorded number to determine the next sequential number. In an alternative embodiment, the control system (via the scanner) may read and record the sequential number of each lottery ticket dispensed, and then transmit the next number in the sequence to the first display.

In a certain embodiment, each bin may further comprise a second electronic display at the front side thereof, for example adjacent to the first electronic display. The control system may be specifically configured to determine the number of the lottery tickets remaining in the bin at the end of the ticket dispense cycle and to transmit the remaining number to the second electronic display for display to potential purchasers. With this configuration, the purchaser is able to determine if the bin contains a ticket having their respective luck number. For example, the number for the next available ticket displayed in the first electronic display may be "0008" and the purchaser's lucky number may be "13." If the second electronic display conveys that 22 tickets remain in the bin, the purchaser may be inclined to purchase 6 tickets from the bin in order to obtain the ticket numbered "0013."

In on embodiment, the control system is a central system that is common to (and in communication with) all of the bins in the array for performing the functions discussed herein. In another embodiment, the control system may be an individual system configured with each bin. For example, each bin may include a control board with logic circuitry to control the dispense mechanism, scanner, and to perform the functions described herein.

Whether a common control system or individual control systems, it may be desired in certain embodiments to configure the control system in communication with a central lottery provider server system for performance of any manner of accounting, verification, invoicing, and the like, functions.

The architecture of each bin can vary within the scope of the invention. For example, in one embodiment, each bin may include a bottom base portion that is configured for interconnecting the bins, wherein the first electronic display is mounted in the bottom base portion. With this configuration, the back side of the bin may include a pivotal door that opens to the internal space for loading of the stack of lottery tickets into the bin, wherein the pivotal door is mounted above the bottom base portion. The scanner, electronic drive mechanism, and control board may all be mounted on the pivotal door.

In yet another embodiment, each bin may also include a third electronic display configured at the back side of the bin and in communication with the control system. This third electronic display faces the store clerk or vendor and is configured to give alert signals that are a function of remaining tickets in the bin. For example, the third electronic display may be a series of different colored LED's, wherein one color indicates that the bin contains a number of lottery tickets above a predefined minimum number. A second color LED may indicate that the number of remaining tickets has decreased to the minimum number, and the third color LED may indicate that the bin is empty.

The third electronic display may also be mounted in the bottom base portion of the bin or mounted to a wall that defines the back side of the bin.

The present invention also encompasses a stand-alone lottery ticket bin as described herein.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
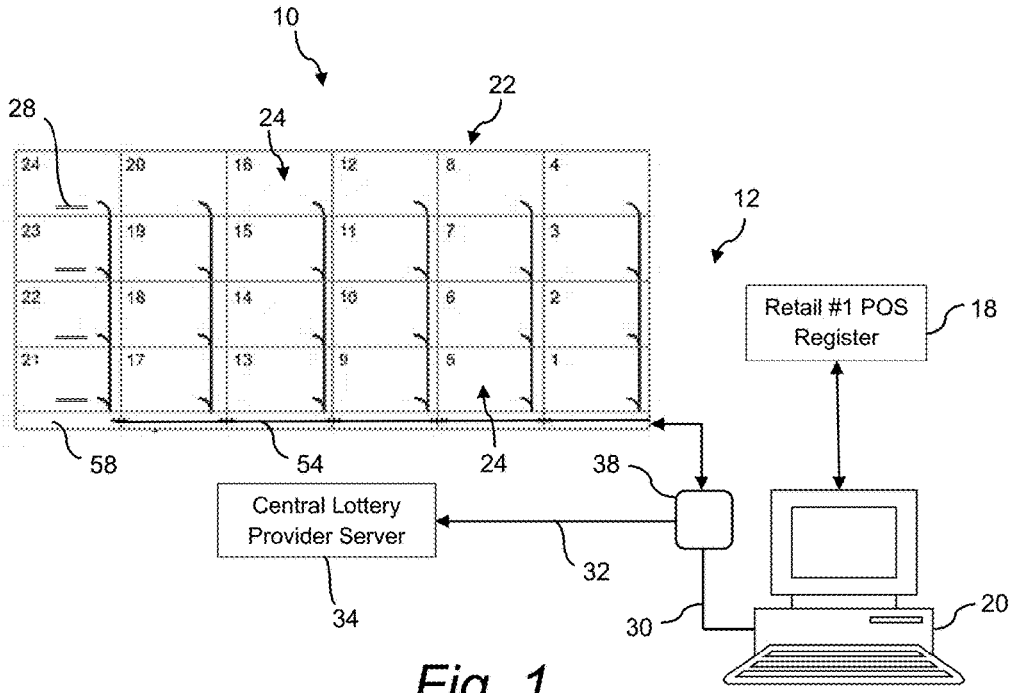
FIG. 1 is a block diagram of a lottery ticket dispenser in accordance with aspects of the present invention.
Figure 3:
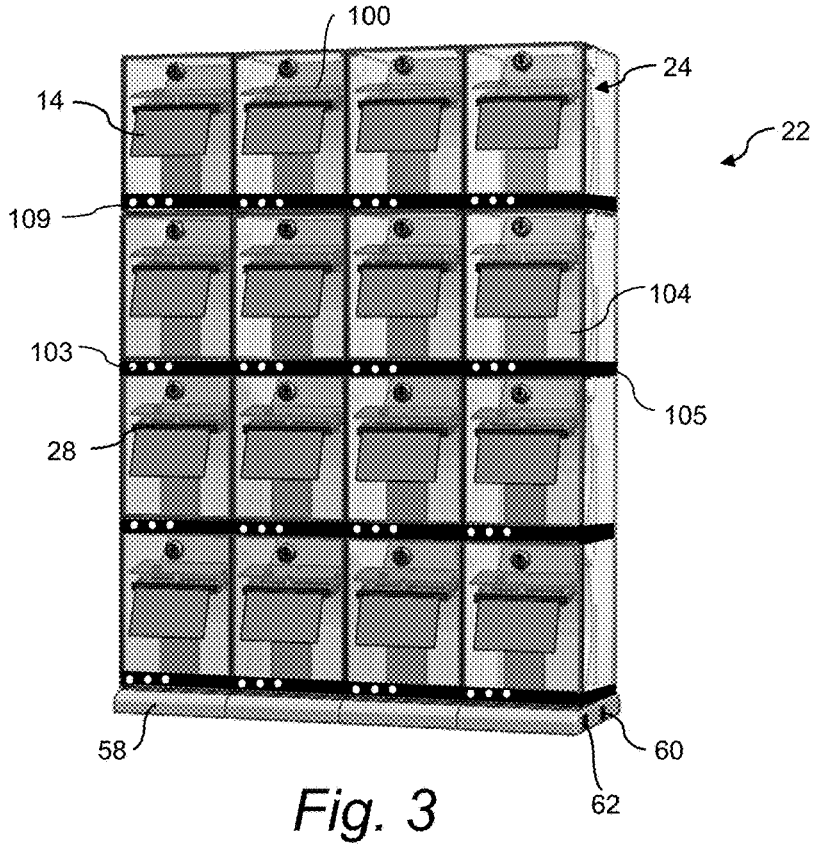
FIG. 3 is a back perspective view of an embodiment of a lottery ticket dispenser.

FIG. 1 depicts an embodiment of a system 10 and related methodology for dispensing lottery tickets 14 (FIGS. 3 and 4) at a retail establishment 12. As mentioned above, the type of retail establishment 12 may vary widely within the scope and spirit of the invention. A retail establishment or location 12, such as a retail store, convenience store, pub, restaurant, or the like, is generally authorized by a lottery jurisdiction to carry out lottery activities, such as the sale of instant scratch-off tickets or terminal printed draw tickets for games such as Powerball™ The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment 12 or lottery jurisdiction entities are not limiting factors of the invention. Although not limited to such, the present system 10 has particular usefulness for larger retail establishments, such as "big-box" retail stores that are part of a national or other geographic chain.

The retail establishment 12 includes one or more retail point-of-sale (POS) registers 18 wherein patrons of the establishment 12 purchase goods. Typically, a scanner is associated with the POS register 18 to scan a UPC code on the products, with the UPC code linked to a purchase price and identification of the products, as is well-known in the art.

In the embodiment of FIG. 1, a lottery ticket terminal 20 is configured in wired or wireless communication with the retail POS register 18 to accept a request for purchase of a particular lottery ticket 14 (FIG. 3) selected from a plurality of different lottery tickets made available to patrons for purchase. This request may be input directly to the terminal 20 or come via the POS register 18. The lottery tickets 14 may be, for example, conventional instant scratch-off lottery tickets. Various types of lottery ticket terminals are known in the art and suitable for configuration with a system 10 in accordance with the invention. For example, Scientific Games Corporation having a principal place of business in Alpharetta, Ga., USA, offers Flair™ and Wave™ lottery ticket terminals that may be readily configured by those skilled in the art for a system as described herein.

A patron's request for a particular scratch-off lottery ticket may be input into the lottery ticket terminal 20 by a retail clerk or other employee of the retail establishment 12 by various means. For example, the terminal 20 may be configured with a scanner, wherein the clerk scans a "master" card having a code corresponding to the particular lottery ticket 14 requested by the patron. Thus, a master card or master code would be provided for each type of lottery ticket 14 offered by the establishment 12. In another embodiment, the terminal 20 may be configured with a touch-screen, keyboard, or other data input device, wherein the clerk enters or identifies the ticket 14 requested by the patron.

Still referring to the embodiment of FIG. 1, a "smart" lottery ticket dispenser array 22 is in wired or wireless communication with the terminal 20. This dispenser array includes one or a plurality of individual lottery ticket bins 24, with each bin 24 typically containing a different respective lottery ticket game. For example, one bin 24 may contain "Lucky 7" themed scratch-off lottery tickets 14, while an adjacent bin 24 may contain "Gold Rush" themed scratch-off lottery tickets 14, and so forth.

Each lottery ticket 14 in the different bins includes a machine readable code 15 (FIG. 6) printed on a front or back side thereof, such as an alpha-numeric code, bar code, QR code, or the like. The type of code may vary depending on the desired information content of the code, space on the ticket 14, and so forth. The use of such codes on lottery tickets 14 for various functions related to inventory, identification, verification, and security are well-known. In accordance with aspects of the invention, the lottery tickets in each bin 24 are generally loaded as a fan-folded stack or roll of sequentially numbered tickets, wherein the machine readable code on each lottery ticket 14 contains this number (as well as any manner of additional ticket information), for example in the form of a serial number embedded in the code.

Referring to the figures in general, each bin 24 in the dispenser array 22 includes an electronic drive mechanism 26 that, when activated, dispenses one or more lottery tickets 14 from the bin 24 (depending on the number of tickets requested by the patron). This drive mechanism 26 may include a motor that drives a friction roller, wherein the tickets 14 are engaged between the friction roll and an idler roll such that driven rotation of the friction roll causes the tickets 14 to be advanced through a dispensing slot 28 in a wall of the individual bin 24. The drive mechanism 26 may also include a sensor 106 that detects a leading and/or trailing edge of adjacent tickets 14 so as to control the run time of the drive mechanism 26 to ensure that perforations between the tickets 14 are presented at a tear bar or other cutting mechanism adjacent to the dispensing slot. For example, such a sensor may be an optical sensor that detects the perforation line between adjacent tickets. Alternately, the friction or idler roll may include an electrical or mechanical encoder that indirectly measures the length of a ticket passing between the rolls as a function or rotations of the roller. In another embodiment, a timing circuit may control the dispense cycle as a function of run time of the motor. It should be appreciated that the drive mechanism 26 may be variously configured to perform the functions of dispensing the requisite number of tickets 14 from the individual respective bin 24 within the scope and spirit of the invention.

In the illustrated embodiments, each bin 24 also includes a scanner 40 disposed so as to read the code on the lottery tickets 14 as they are dispensed from the bin 24. The scanner 40 may be any conventional barcode reader, such as a point scanner, linear scanner, laser scanner, LED image scanner, and so forth. The tickets 14 are loaded into the bins 24 such that the code printed on each ticket passes within the detection field of the scanner 40. An integral (or separate) reader is configured with the scanner 40 to decode the scanner signal.

Referring to FIGS. 4 through 8 in general, each bin 24 in the array 22 includes a first electronic display 109 at the front side thereof, such as an LCD display that is located on the front side of the bin 24 so as to be clearly visible to a prospective purchaser.

Figure 5:
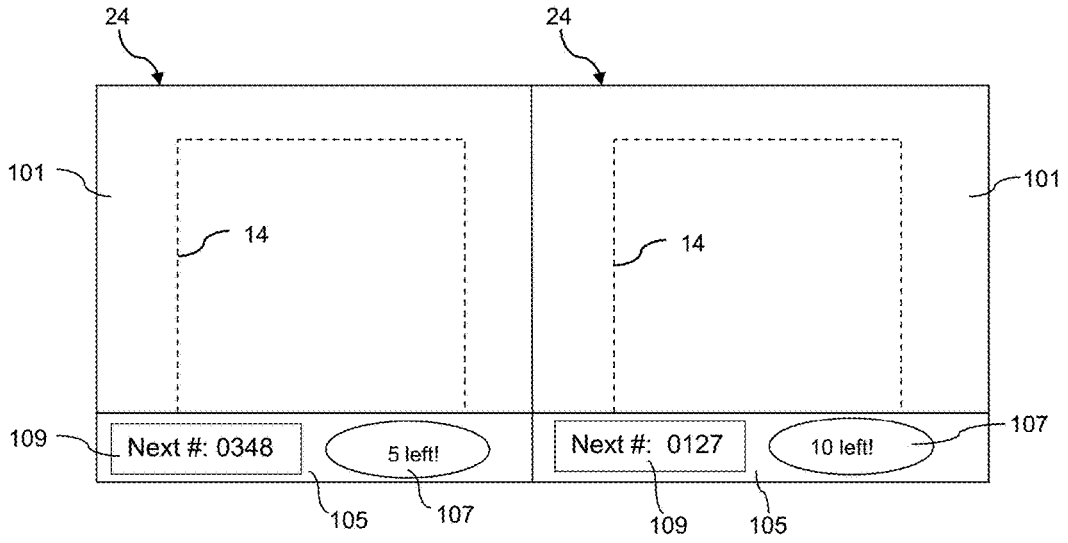
FIG. 5 is a diagram view of the front side of adjacent bins of a lottery ticket dispenser in accordance with aspects of the invention.
Figure 6:
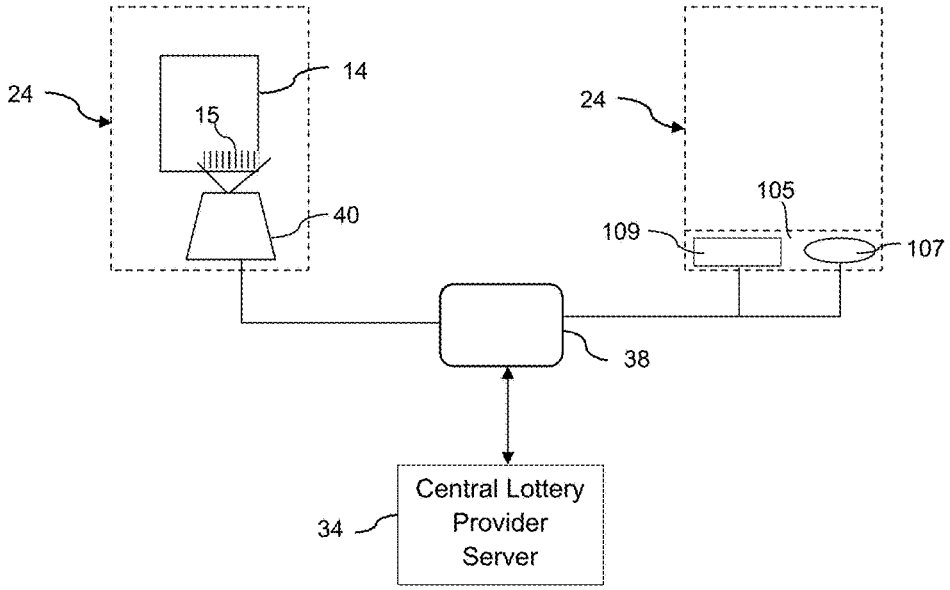
FIG. 6 is a diagram view of certain control aspects of the lottery ticket dispenser.

For each bin 24, a control system 38 is in communication with the scanner 40 and is specifically configured for receipt of the scan signal from the scanner 40. For each bin 24, at the end of a ticket dispense cycle, the control system 38 is specifically configured to determine the lottery ticket number of a next lottery ticket 14 to be dispensed from the bin 24 and to transmit this next lottery number to the first electronic display 109, which displays this number to the potential purchaser. For example, as depicted in FIGS. 5 and 6, based on a scan signal received from the scanner 40 of each bin 24, the control system is able to determine that, for the left-hand bin 24 in FIG. 5, the next available ticket 14 has a sequential number of "348" and the next available ticket 14 in the right-hand bin 24 has a sequential number of "0127." These respective numbers are transmitted to the first electronic display 109 of each bin 24, respectively and are readily visible to potential purchaser standing in front of the array 22. Thus, the purchaser is presented with the sequential number of the ticket that is available for purchase in each bin and is able to select tickets that contain his "lucky number."

The control system 38 may determine the sequential number of the next lottery ticket 14 available in each of the bins 24 in various ways. For example, once determined, the control system 38 records the sequential number of the next available ticket in the bin 24 and, at the next dispense cycle, does a ticket count of the number of tickets dispensed during such cycle. This count (plus one) is then added to the last recorded sequential number to determine the sequential number of the next available ticket from the bin 24. For example, referring to FIG. 5, the control system 38 has determined and recorded the sequential number "0348" for the left-hand bin 24. If five tickets are purchased from this bin 24 in the next dispense cycle, the control system counts the number of dispensed tickets ("5") and adds this amount plus "1" to display the sequential number "0354" for the next available ticket 14 from the bin 24. The count of number of tickets dispensed is easily determined, for example by counting perforation lines (via sensor 106), computing the number of tickets from run time of the drive mechanism 26, data from an encoder configured with the drive mechanism 26, and so forth.

In an alternative embodiment, the control system 38 (via the scanner 40) may read and record the sequential number of each lottery ticket 14 dispensed from a bin 24, and then transmit the next number in the sequence to the first display 109 at the end of a dispense cycle.

Still referring to FIGS. 4 through 8, in a certain embodiment, each bin 24 may further comprise a second electronic display 107 at the front side thereof, for example adjacent to the first electronic display 109. This second display 107 may be separate from the first display 109, or may constitute a field of the first display 109. The intent here is that the second electronic display 107 transmits information in addition to that displayed by the first display 109. The control system 38 is, in this embodiment, specifically configured to determine the number of the lottery tickets remaining in the bin 24 at the end of the ticket dispense cycle and to transmit this remaining number to the second electronic display 107 for display to potential purchasers. This number is readily determined by the control system 38, which is programmed with the total number of tickets contained within a stack or roll of tickets 14. By tracking the number of tickets 14 dispensed, the control system 38 can mathematically determine the number of tickets remaining in each bin 24. With this configuration, the purchaser is able to determine if a particular bin 24 contains a ticket 14 having their respective lucky number. For example, the number for the next available ticket displayed in the first electronic display 109 may be "0008" and the purchaser's lucky number may be "13." If the second electronic display 107 conveys that 22 tickets remain in the bin, the purchaser may be inclined to purchase six tickets from the bin 24 in order to obtain the ticket numbered "0013."

Figure 7:
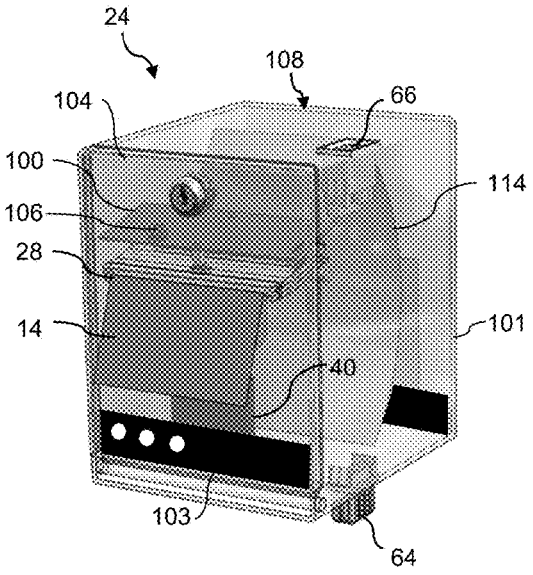
FIG. 7 is a front perspective view of a lottery ticket bin in accordance with the invention.
Figure 8:
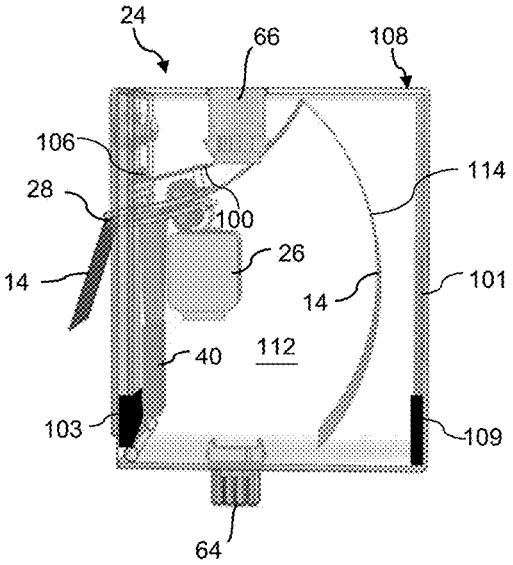
FIG. 8 is a side view of the bin embodiment of FIG. 7.

In still a further embodiment depicted in FIGS. 7 and 8, each bin 24 may also include a third electronic display 103 configured at the back side of the bin 24 so as to face the retail clerk or vendor in operation of the system 10. This third display 103 is also in communication with the control system 38 and is configured to give alert signals that are a function of remaining tickets in the bin. For example, the third electronic display may be a series of different colored LED's, wherein one color (e.g., green) indicates that the bin contains a number of lottery tickets 14 above a predefined minimum number. A second color LED (e.g., yellow) may indicate that the number of remaining tickets 14 has decreased to the minimum number, and the third color LED (red) may indicate that the bin 24 is empty.

Referring for example to FIG. 1, the control system 38 may be a central system that is common to (and in communication with) all of the bins 24 in the array for performing the functions discussed herein. This central control system 38 may be physically configured with the array 22 (e.g., within a base structure) or may be remote from the array 22.

Figure 2:
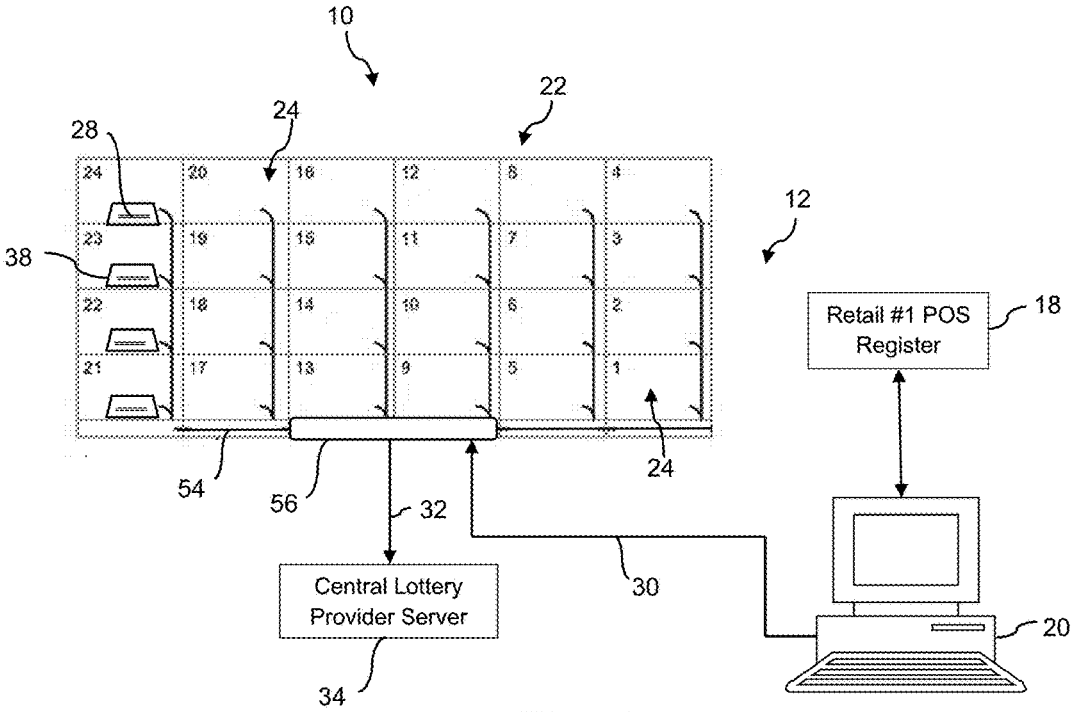
FIG. 2 is a block diagram of another embodiment of a lottery ticket dispenser in accordance with aspects of the present invention.

In another embodiment depicted for example in FIG. 2, the control system 38 may be an individual system configured with each bin 24. For example, referring to FIGS. 7 and 8, each bin 24 may include a control board 100 having logic circuitry to control the various components within the bin 24, such as the leading edge sensor 106, drive motor timing circuit, electronic displays 107, 109, and so forth. Any manner of control or power components can be mounted on the board 100 for operation of the individual bins 24 as described herein. FIG. 2 depicts individual control systems 38 for each bin 24 in direct communication with the terminal 20 via a signal router 56 integrated with the dispenser array 22. This router 56 routes the purchase signal 30 from the lottery ticket terminal 20 to the correct bin 24.

Referring to FIGS. 1 and 2, the lottery ticket terminal 20 transmits a purchase signal 30 for dispensing a particular lottery ticket 14 that is routed to the respective bin 24 within the dispenser array 22 containing the requested lottery ticket. This purchase signal 30 may be sent to an individual control system 38 associated with the bin 24 (FIG. 2), or to a common control system 38 associated with all of the bins 24 (FIG. 1), to activate the drive mechanism 26 and dispense the requisite number of lottery tickets 14 from the bin 24.

In an alternate embodiment, the purchase signal 30 is generated by the POS register 18 and transmitted to the control system 38 after the POS register 18 receives a purchase code from the lottery ticket terminal 20 corresponding to the particular ticket requested by the patron.

The system 10 may include a central lottery server 34 that is common to a number of different retail establishments 12. As described above, as the tickets 14 are dispensed from the bin 24, the scanner 40 reads the code printed on each ticket or, alternatively, the first and last codes printed on sequentially dispensed tickets. A signal 32 corresponding to the scanned code may be routed to the central lottery server 34 for each lottery ticket dispensed from the dispenser array 22 to enable certain actions relevant to the sale/dispensing of the individual tickets 14. For example, the central lottery server 34 may include a database of all tickets delivered to the respective retail establishments 12, and the near instantaneous identification of dispensed/sold lottery tickets 14 to the server 34 enables various desired functionalities. For example, the individual lottery tickets 14 may remain "inactive" in the lottery provider's system (and thus unable to be redeemed) until individually activated by the central lottery server 34 as they are dispensed and sold. Thus, fraudulently obtained tickets (e.g., stolen or otherwise illegally obtained) cannot be redeemed. This is contrary to a conventional practice of activating entire books ("packs") of tickets upon delivery to a retail establishment 12.

The present system 10 allows for enhanced accountability of lottery tickets 14 sold at a particular retail establishment 12 by logging each ticket as it is sold and dispensed. The number of tickets 14 sold during a work shift (or other time period) is easily determined by generating a report by the central server 34 of the tickets sold at any of the retail establishments during any defined time period. The number of tickets 14 sold at any of the retail establishments 12 can be readily reconciled with tickets delivered to the establishment. Likewise, the number of tickets 14 dispensed during a defined time can be readily and electronically reconciled with reported purchase transactions from the respective establishment 12, with discrepancies being immediately identified for further investigation.

Another particular advantage of the system 10 and associated method is that billing practices between the retail establishments 12 and lottery authority, the lottery service provider, or ticket manufacturer can be based on real-time sales of the lottery tickets 14. For example, the retail establishments 12 can be invoiced on a periodic basis (e.g., daily or weekly) for the actual number of tickets sold (dispensed) at each respective establishment based on the signals 32 routed to the central lottery server 34 instead of upon delivery, or other payment methodology typically in use today. These include but are not limited to consignment for a predetermined time period, or estimate of sales based on the number of winning tickets cashed from a pack of tickets being sold.

It should be appreciated that the terms "server" is used herein to encompass any configuration of computer hardware and software that is maintained by a lottery authority or game provider to carry out the functionalities of the present system 10 and associated method, as well as any manner of additional lottery functions known to those skilled in the art. It should be readily appreciated that the server 34 may include an integrated server, or any manner of periphery server or other hardware structure. The central lottery server 34 is typically remote from the retail establishments 12, and is in communication with the establishments 12 via a suitable secure communication network, which may include any manner of wide area network, wireless internet, or cloud computing. The server 34 may be a single networked computer, or a series of interconnected computers having access to the communications network via a gateway or other known networking system. Generally, the server 34 is configured to communicate with, manage, execute and control individual lottery terminal units 20 within the lottery jurisdiction. The server 34 may be a "front end" server provided by the lottery game provider that is interfaced with the existing draw/instant game system infrastructure one or more separate lottery authorities. The server 34 may include a memory for storing gaming procedures and routines, a microprocessor (MP) for executing the stored programs, a random access memory (RAM) and an input/output (I/O) bus. These devices may be multiplexed together via a common bus, or may each be directly connected via dedicated communications lines, depending on the needs of the system 10.

The server 34 may be directly or indirectly connected through an I/O bus to any manner of peripheral devices such as storage devices, wireless adaptors, printers, and the like. In addition, a database (DB) may be communicatively connected to the server 34 and provide a data repository for the storage and correlation of information gathered from the individual dispenser arrays 22, such as the identity of each lottery ticket 14 dispensed from the array, the time of the dispense sequence, confirmation of ticket activation, and so forth.

It should be appreciated that embodiments of the methods and systems 10 disclosed herein may be executed by one or more suitable networked lottery gaming components and establishment components (e.g., POS register 18, back office server, and so forth) within a plurality of the establishments 12, as well as the remote central server 34. Such gaming systems and computing devices may access one or more computer-readable media that embody computer-readable instructions which, when executed by at least one computer, cause the computer(s) to implement one or more embodiments of the methods of the present subject matter. Additionally or alternatively, the computing device(s) may comprise circuitry that renders the device(s) operative to implement one or more of the methods of the present subject matter. Furthermore, components of the presently-disclosed technology may be implemented using one or more computer-readable media.

As mentioned above, aspects of the present system 10 and methods rely on the transmission of data over one or more communications networks. It should be appreciated that network communications can comprise sending and/or receiving information over one or more networks of various forms. For example, a network can comprise a dial-in, public switched telephone network (PSTN), a local area network (LAN), wide area network (WAN), the Internet, an intranet or other type of network. A network may comprise any number and/or combination of hard-wired, wireless, or other communication links.

The architecture of each bin 24 and the array 22 can vary within the scope of the invention. Referring to FIGS. 1 through 4, the dispenser array 22 includes a bottom row of bins 24 having interconnected base structures 58. For example, each base structure 58 may include a male power plug and male data plug along one side, and a female power port 60 and female data port 62 along the opposite side. The plugs and ports of adjacent base structures 58 interconnect to essentially define a data bus 54 (FIGS. 1 and 2) running the length of the base structures 58. An exposed power port 60 and data port 62 at one of the ends of the interconnected base structures is available for connection with a power cord and a data cord from the system control system 38 or lottery terminal 20.

Figure 4:
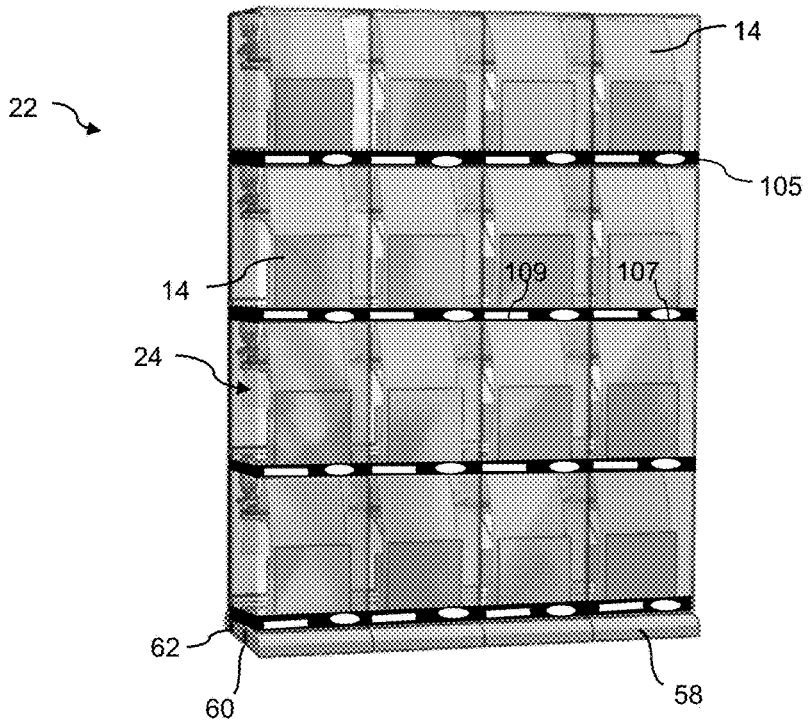
FIG. 4 is a front perspective view of the lottery ticket dispenser of FIG. 3.

Referring to FIGS. 7 and 8 in particular, each of the individual bins 24 includes a multi-sided housing 108 defining an internal space 112 in which the stack or roll of lottery tickets 14 is stored. In the depicted embodiments, the housing 108 is a box-like member having top and bottom walls, side walls, a front wall 101, and a pivotal back wall or panel 104. The back panel 104 swings open to provide access into the housing 108 for loading the ticket stack. As shown in FIG. 4, each bin 24 may include a sample ticket 14 or other identifying insert attached to a front face of the bin 24 that faces the patrons so that the patron is aware of the exact tickets available for purchase. Each bin 24 includes a male power/data connector 64 on the top or bottom surface, and a corresponding female power/data connector 66 on the opposite surface, as seen in FIGS. 7 and 8. With this configuration, a plurality of the bins 24 can be vertically stacked and interconnected, as depicted in the various figures.

As depicted in FIGS. 3 through 8, in a certain embodiment, each bin 24 may include a bottom base portion 105 that incorporates the ports 64, 66 and is configured for interconnecting the bins, wherein the first electronic display 109 and second electronic display 107 are mounted in the bottom base portion 105. With this configuration, the pivotal door 104 at the back side of the housing 108 may be mounted above the bottom base portion 105. The scanner 40, electronic drive mechanism 26, and control board 100 may all be mounted on the pivotal door 104, as shown in FIGS. 7 and 8.

Referring to FIGS. 7 and 8, in an alternate embodiment, the first and second electronic displays may be incorporated in the front wall 101 of each bin, wherein the bottom base portion 105 is eliminated.

The third electronic display 103 may also be mounted in the bottom base portion 105 of each bin 24 (FIG. 3), or may be mounted to the pivotal wall 104 that defines the back side of the bin 24, as depicted in FIGS. 7 and 8.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser array, comprising:

a plurality of separate bins, each bin defined by a housing having a front side that faces a purchaser in operational use of the dispenser array, an opposite back side having a dispensing slot defined therein, and an internal space for receipt of a supply of interconnected lottery tickets, wherein the lottery tickets are sequentially numbered and each lottery tickets contains a code printed thereon that includes the lottery ticket number;

each bin having an electronic drive mechanism that dispenses the lottery tickets therefrom;

each bin comprising a scanner disposed to read the code as the lottery tickets are dispensed from the bin;

a control system in communication with each scanner;

each bin comprising a first electronic display at the front side thereof;

for each bin, the control system specifically configured for receipt of a scan signal from the scanner and, at the end of a ticket dispense cycle, to determine the lottery ticket number of a next lottery ticket to be dispensed from the bin and to transmit the next lottery number to the first electronic display in a human-readable alpha-numeric form; and wherein the first electronic display is configured to display to potential purchasers the lottery ticket number in the human-readable alpha-numeric form for the next lottery ticket to be dispensed from the bin.

2. The lottery ticket dispenser as in claim 1, wherein each bin further comprises a second electronic display at the front side thereof, the control system specifically configured to determine a remaining number of the lottery tickets remaining in the bin at the end of the ticket dispense cycle and to transmit the remaining number to the second electronic display for display to potential purchasers.

3. The lottery ticket dispenser as in claim 1, wherein the control system is common to all of the bins in the array.

4. The lottery ticket dispenser as in claim 1, wherein the control system is an individual control system for each bin.

5. The lottery ticket dispenser as in claim 1, wherein the control system is in communication with a central lottery provider server system.

6. The lottery ticket dispenser as in claim 1, wherein each bin comprises a bottom base portion, the first electronic display mounted in the bottom base portion.

7. The lottery ticket dispenser as in claim 6, wherein the back side of the bin comprises a pivotal door that opens to the internal space for loading of the stack of lottery tickets into the bin, the pivotal door mounted above the bottom base portion.

8. The lottery ticket dispenser as in claim 7, wherein the scanner and electronic drive mechanism are mounted on the pivotal door.

9. The lottery ticket dispenser as in claim 1, wherein each bin further comprises a third electronic display configured at the back side of the bin and in communication with the control system, the third electronic display configured to give alert signals to a retailer operating the dispenser as a function of remaining tickets in the bin.

10. The lottery ticket dispenser as in claim 9, wherein each bin comprises a bottom base portion, the third electronic display mounted in the bottom base portion.

11. The lottery ticket dispenser as in claim 9, wherein the back side of the bin comprises a wall, the third electronic display mounted to the wall.

* * * * *